US005375392A

United States Patent [19]

Oberdorf

[11] Patent Number: 5,375,392

[45] Date of Patent: Dec. 27, 1994

[54] FORMATION OF CIGARETTE BLOCKS

[75] Inventor: Manfred Oberdorf, Gevelsberg, Germany

[73] Assignee: Maschinenfabrik Alfred Schmermund GmbH & Co., Gevelsberg, Germany

[21] Appl. No.: 22,076

[22] Filed: Feb. 24, 1993

[30] Foreign Application Priority Data

Feb. 26, 1992 [DE] Germany ..... 4205879

[51] Int. Cl.[5] ..... B65B 19/10

[52] U.S. Cl. ..... 53/149; 131/283; 414/792.5; 198/418.1

[58] Field of Search ..... 53/148, 149, 150, 151, 53/236; 131/282, 283; 198/418.1, 418.3; 414/797.9, 790.3, 792.5

[56] References Cited

U.S. PATENT DOCUMENTS

| | | | |
|---|---|---|---|
| 1,601,257 | 9/1926 | Molins | 53/149 |
| 1,961,047 | 5/1934 | Horgan | 53/149 |
| 2,621,840 | 12/1952 | Kemp . | |
| 4,362,235 | 12/1982 | Erdmann | 53/149 X |
| 4,586,314 | 5/1986 | Morge et al. | 53/149 X |
| 5,201,162 | 4/1993 | Focke | 53/151 X |

FOREIGN PATENT DOCUMENTS

| | | |
|---|---|---|
| 2453625 | 11/1974 | Germany . |
| 3102170 | 1/1981 | Germany . |
| 3116156 | 4/1981 | Germany . |
| 528492 | 5/1939 | United Kingdom . |
| 2067982 | 1/1981 | United Kingdom . |

*Primary Examiner*—Linda B. Johnson
*Attorney, Agent, or Firm*—Chilton, Alix & Van Kirk

[57] ABSTRACT

Cigarette blocks comprising an even number of individual cigarettes arranged in an odd number of rows are formed through the use of a hopper having a linear array of parallel shafts with one of the shafts being permanently occupied by a blocking member at the level of an intermediate row. Cigarettes are delivered singly to the blocked shaft beneath the blocking member in synchronism with the transfer, in a direction transverse to the feed direction, of all of the cigarettes comprising the block to downstream apparatus.

9 Claims, 4 Drawing Sheets

FORMATION OF CIGARETTE BLOCKS

BACKGROUND OF THE INVENTION

1. Field of the Invention

The present invention relates to the grouping of individual cigarettes into "blocks" for subsequent packaging and particularly to the formation of cigarette blocks comprising three rows of cigarettes with the middle row containing one cigarette less than the outer rows. More specifically, this invention is directed to apparatus for reliably and gently assembling individual cigarettes into generally rectangular-shaped groups, these groups being defined by an odd number of rows with an even total number of cigarettes, the apparatus further including means for delivering the assembled group of cigarettes as a unit into downstream apparatus for subsequent wrapping. Accordingly, the general objects of the invention are to provide novel and improved methods and apparatus of such character.

2. Description of the Prior Art

It is customary to package cigarettes in groups of twenty, such groups typically being comprised of two outer rows having seven cigarettes each and a middle row, wherein the cigarettes are staggered with respect to those in the outer rows, comprising six cigarettes. Apparatus for forming such three row cigarette "blocks" are known in the art. An exemplary such device may be seen from published German Patent Application 3,116,156. In the apparatus of this published German application, subsequent to arrangement of the cigarettes to be packaged into three rows of equal length, one cigarette in the middle row is laterally restrained when the remaining cigarettes are ejected from the block forming device. The restraint of this one cigarette in the middle row is accomplished through the use of a mechanical stop. During movement of the cigarettes which are being ejected as a unitary "block", the contact between the cigarettes being ejected and the cigarette being retained results in friction which may damage the relatively fragile cigarette. Any such damage is unacceptable since the retained cigarette will be included in the next succeeding block which is formed. Additionally, the separating-out of an individual cigarette requires a precisely coordinated and synchronized process. Bearing in mind that the cigarettes are delivered under the influence of gravity to the point where they are arranged in multiple-layer rows, it is possible that one cigarette may move into position more slowly than another. Any such uneven movement will upset the synchronism of the separation transfer procedure and will contribute to the possibility of damage to an individual cigarette. While the possibility of cigarette damage, particularly due to uneven speed of movement, can be reduced by judicious selection of the size of the shafts in which the rows of cigarettes are formed, it is impossible to totally eliminate the possibility of a damaged cigarette. Accordingly, the prior art apparatus must be provided with a mechanism which halts the production line when the retained cigarette is subjected to a relatively large, and thus potentially damaging, force. Interruptions in the packaging process resulting from halting the block forming apparatus are, of course, very undesirable due to the "ripple effect" such interruptions have on various other devices such as, for example, the devices which supply the wrapping material.

SUMMARY OF THE INVENTION

The present invention overcomes the above-briefly discussed and other deficiencies and disadvantages of the prior art by providing a method of, and apparatus for, gently and reliably forming individual cigarettes into blocks comprised of an even number of cigarettes disposed in an odd number of rows. Apparatus in accordance with the present invention includes means for arranging loose cigarettes in adjacent parallel shafts and for subsequently ejecting the cigarettes from the shafts as multi-row blocks having the required number of cigarettes in each row.

In accordance with a preferred embodiment of the invention, the cigarettes are delivered to an array of parallel shafts with the shaft at one end of the array being blocked, by an immobile mechanical member, in the region which corresponds to an intermediate one of three rows. The apparatus also includes means for delivering individual cigarettes to this end shaft at the position corresponding to the bottom row, i.e., beneath the blocking member. The means for delivering the cigarettes to the bottom of the shaft at the end of the array may be operated in synchronism with the transfer device which ejects the entire cigarette block from the block forming apparatus as a unit.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENTS

Figure 1:
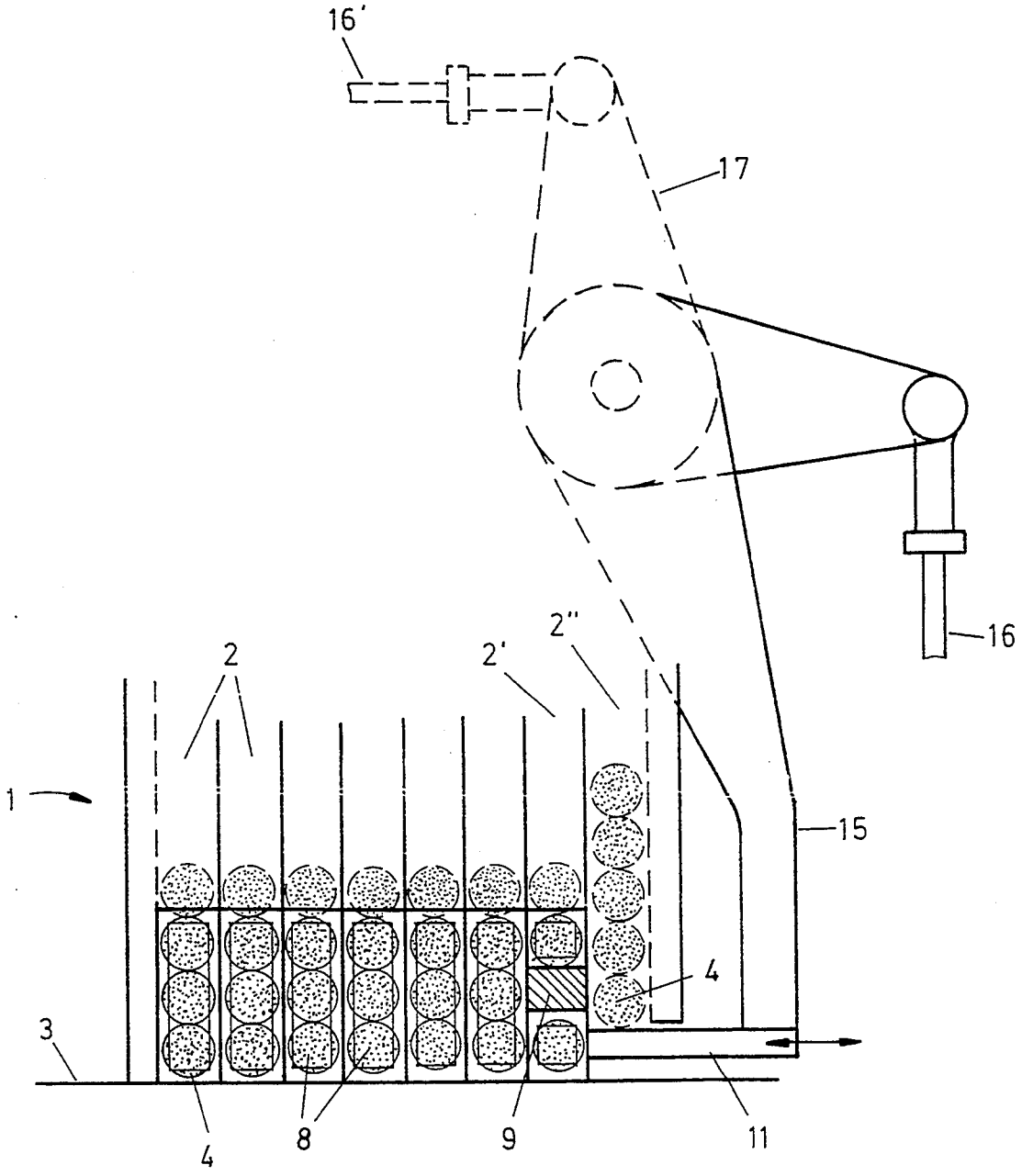
FIG. 1 is a schematic, rear elevational view of a first embodiment of apparatus for forming cigarette blocks in accordance with the present invention.
Figure 2:
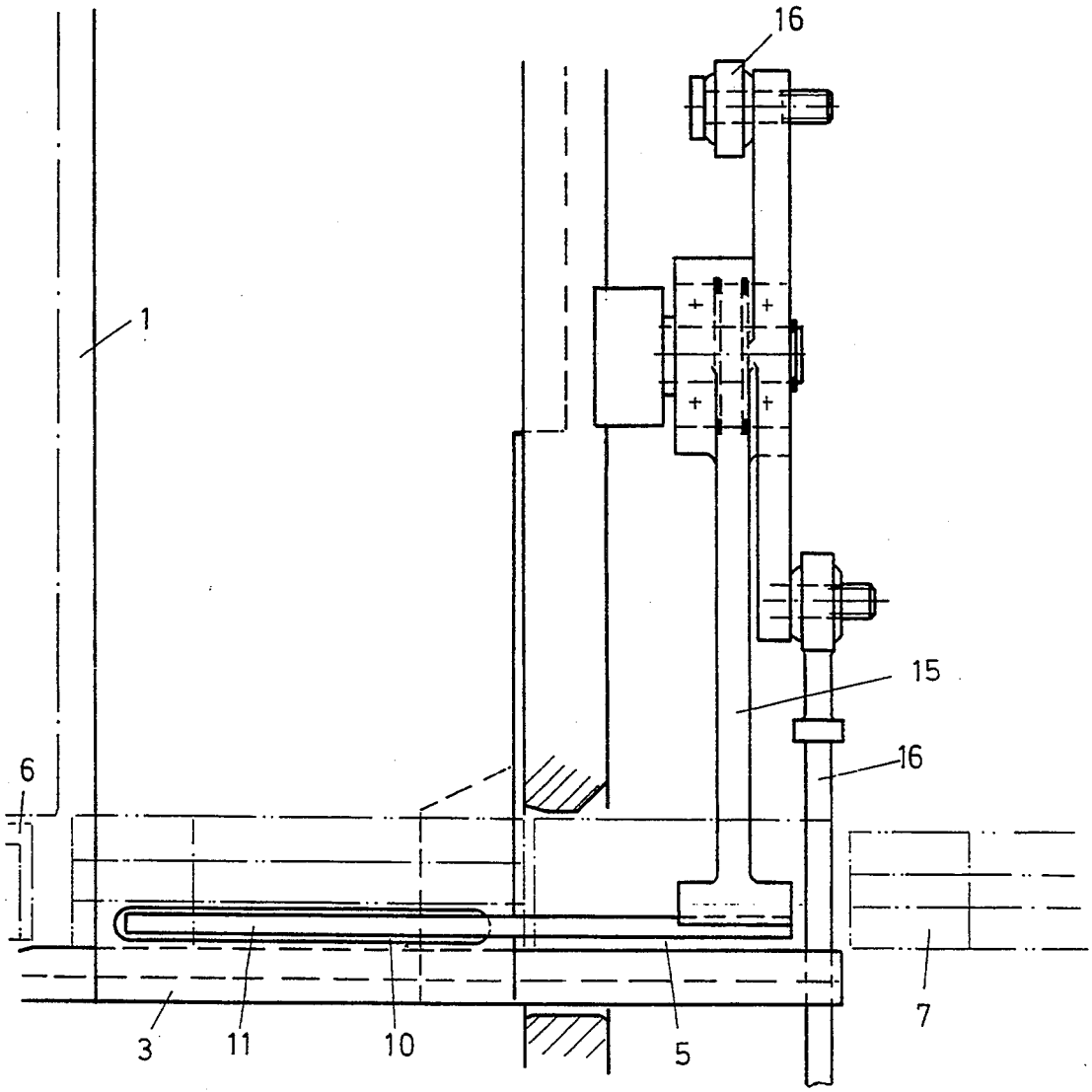
FIG. 2 is a side elevation view of the apparatus of FIG. 1.
Figure 3:
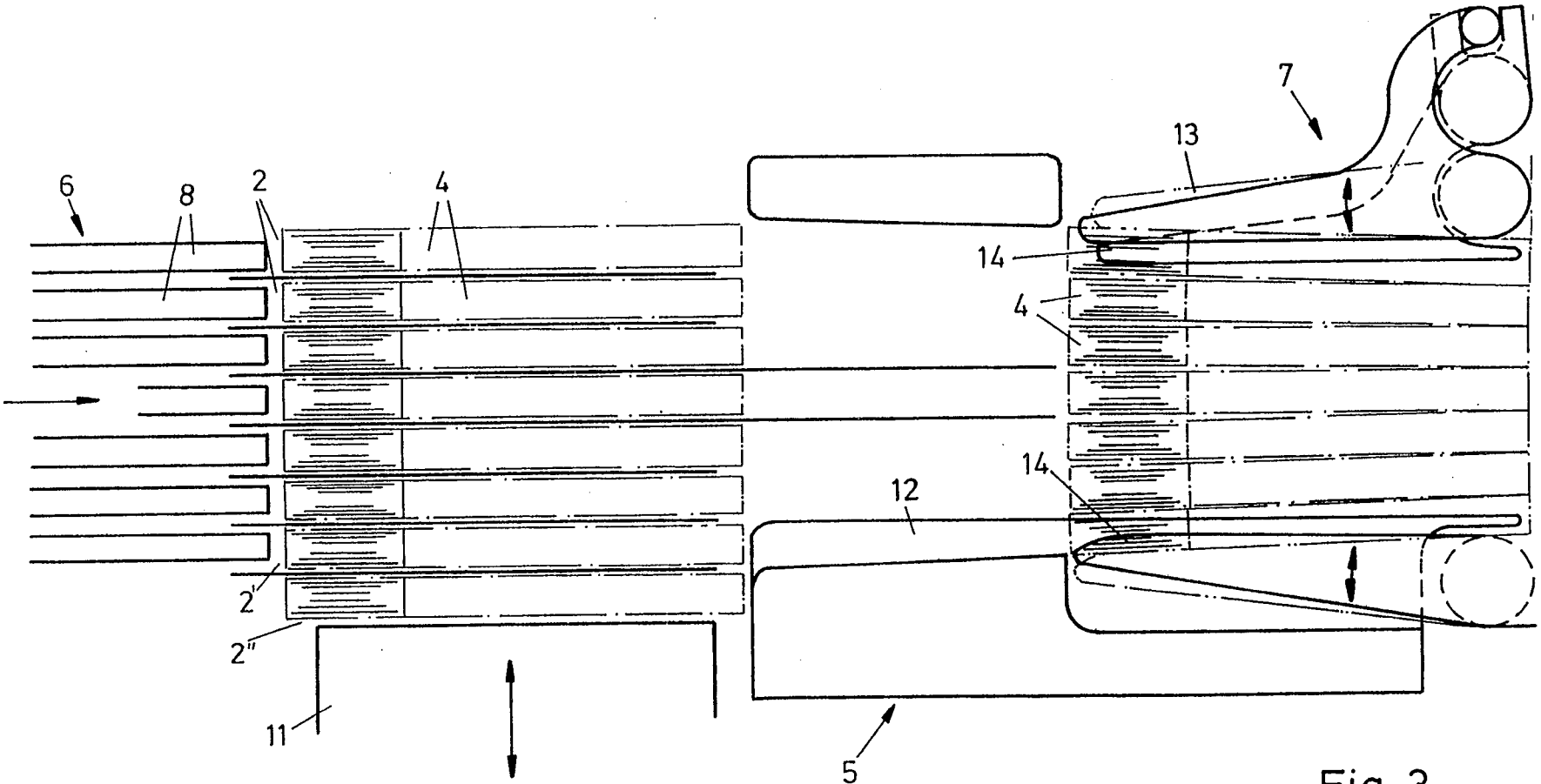
FIG. 3 is a top plan view of the apparatus of FIGS. 1 and 2.

With reference now to FIGS. 1–3 of the drawings, apparatus for forming cigarette blocks in accordance with a first embodiment of the invention comprises a hopper which has been indicated generally at 1. Hopper 1 includes a plurality of parallel, vertically oriented walls which define an array of side-by-side shafts 2. The walls which define the shafts 2 extend upwardly from a base plate 3. In the lower regions thereof, the opposing ends of the shafts 2 are open to a height determined by a first dimension of the cigarette block to be formed, the open shaft ends thus defining a generally rectangularly shaped ejection area. In the disclosed embodiment, which is the conventional configuration, the ejection area has a height corresponding to three cigarettes 4. Thus, the cigarette block to be formed will comprise three rows of cigarettes in the first or height dimension and, as will be described in more detail below, will have a length in the transverse direction which is approximately commensurate with the diameter of seven cigarettes.

A mouthpiece, indicated generally at 5, is positioned in front of hopper 1 in the direction of movement of the cigarettes 4 during the ejection thereof. Thus, once the cigarettes are arranged such that all of the spaces in the ejection area of hopper 1 have been filled, they will be pushed from the hopper through the mouthpiece 5 and into a transfer cell which has been indicated generally at 7. Once in the transfer cell, the cigarettes will be conveyed to a packaging station where they will be suitably wrapped.

The transfer of the cigarettes from hopper 1 through mouthpiece 5 is accomplished by means of a block pusher 6. In the disclosed embodiment, the block pusher 6 comprises a row of adjacently disposed pusher elements 8. The pusher elements 8 extend, with the exception of the pusher element which is in registration with shaft 2', over a vertical level of somewhat less than the diameters of three cigarettes 4. The pusher element 8 which is in registration with hopper shaft 2' is fork-shaped, i.e., has a pair of spaced tines or fingers, so that it will engage cigarettes disposed only in the lowermost and third rows. The block pusher 6 is reciprocated in synchronism with a conveyor by drive means which has not been shown in the drawings. This drive means may, for example, comprise a crank drive. The individual pusher elements 8 of block pusher 6 act upon the filter ends of the cigarettes 4 and, by virtue of being guided through the ejection area defined by the lower ends of the shafts 2 of hopper 1, simultaneously eject the cigarettes 4 from the hopper in the form of a cigarette block. In the disclosed embodiment, as will be described in further detail below., this block comprises first and third, i.e., lowermost and upper, rows consisting of seven cigarettes each and an intermediately disposed row of six cigarettes. Thus, the block comprises the customary twenty cigarettes which are wrapped to form a pack.

The number of shafts 2 provided in hopper 1 exceeds by one the maximum number of cigarettes 4 which comprise the rows of the cigarette block to be formed, i.e., in the disclosed embodiment, where the upper and lower rows of the block will comprise seven cigarettes, there are eight shafts in hopper 1. The shaft 2', which is in communication with one end of the ejection area, is provided with a blocking member in the form of web 9. Web 9 occupies the space in shaft 2' corresponding to the second row of cigarettes. The web 9 prevents the filling of shaft 2' in the two rows above base plate 3. The shaft 2' is, at its lower end, open in the direction of a further shaft 2''. Shaft 2'', in the region which is in registration with the lower row of cigarettes in the ejection area, is provided with a pass-through opening 10 for a pusher element 11. The pusher element 11 thus may transfer a single cigarette, from the bottom of a column of cigarettes disposed in shaft 2'', laterally into the lowermost position in shaft 2'. This feeding of cigarettes into the lowermost position in shaft 2' is performed in synchronism with the operation of the block pusher 6 thus insuring that a cigarette 4 is located beneath web 9 each time a block of cigarettes is transferred from hopper 1 through mouthpiece 5 and into a transfer cell 7. Thus, as explained above, block pusher 6 is able to eject three rows of cigarettes 4, the middle row containing one cigarette less than the two outer rows, whereby the block of loose cigarettes moved as a unit will comprise three rows having, for example, 7+6+7 cigarettes.

The mouthpiece 5 is provided, at the level of web 9, with an inwardly directed guide rail 12. Guide rail 12 extends in the direction of movement of the cigarettes 4 and prevents the shifting of the cigarettes comprising the block relative to one another during the initial movement thereof from hopper 1. The transfer cell 7 narrows in the direction of movement of the cigarette block and includes movable webs 14. The movable webs 14 can be swiveled inwardly with respect to the sidewalls of transfer cell 7 under spring pre-tension to a depth corresponding approximately the radius of a cigarette. The webs 14 thus assist the positioning of the cigarettes 4 of the middle row such that they assume a staggered orientation relative to the cigarettes of the two outer rows. Accordingly, by the time the cigarette block is fully inserted into the transfer cell 7, the cigarettes comprising the block will have achieved the correct arrangement for subsequent wrapping.

The pusher element 11 of the embodiment of FIGS. 1—3 is coupled to the end of a lever arm 15. Reciprocating movement of the pusher element 11 may be produced by means of a crank drive which cooperates with lever 15. Lever 15 is pivotally mounted on the front side of the hopper 1 and can be actuated via a hinge rod 16. For increased production, it is possible to provide hopper 1 with two ejection ends and, in such case, the lever 15 may be provided with a continuation 17 which is coupled to a further hinge rod 16' which, in turn, will actuate a further lever which operates in the same manner as lever 15.

Figure 4:
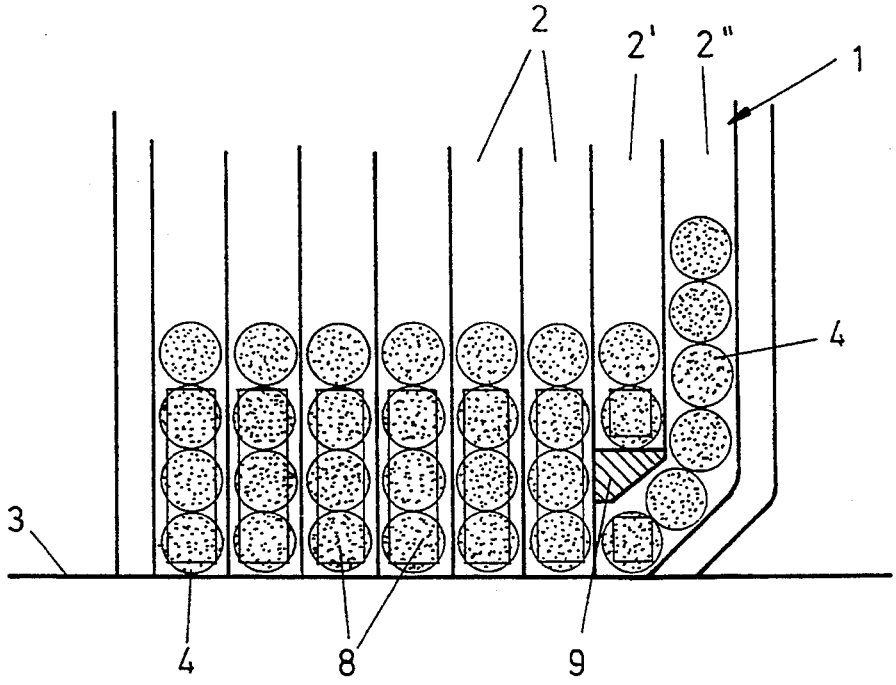
FIG. 4 is a view, similar to FIG. 1, which schematically shows a portion of a second embodiment of apparatus in accordance with the invention.

Referring to FIG. 4, wherein only the hopper 1 is depicted, in a modified form of the invention cigarettes are fed to the lower position in shaft 2' solely under the influence of gravity. For this purpose, the lower end of the outer wall of the hopper, which wall in part defines shaft 2'', is angled and the web 9 is provided with a parallel, angled bottom surface.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. Apparatus for the formation of blocks of cigarettes, the blocks consisting of three rows of cigarettes with the middle row containing one cigarette less than the outer rows, said apparatus comprising:

hopper means, said hopper means defining a plurality of parallel shafts, said shafts comprising walls which extend upwardly from a common base, said shafts having a width which exceeds the diameter of the cigarettes, the number of said shafts being at least equal to the number of cigarettes which form the said outer rows of a block to be formed, said shafts being arranged in side-by-side fashion in a linear array, an immobile member being positioned in one of the end shafts of the array at the level of said middle row, said immobile member occupying the space for a cigarette thereby preventing a cigarette from occupying said space in said end shaft middle row, said immobile member creating a space for a cigarette between said base and said immobile member;

means for feeding a cigarette to said space between said immobile member and said base; and ejector means for simultaneously transferring all of the cigarettes disposed in said three rows from said hopper means;

wherein said feeding means feeds a cigarette to said space between said base and said immobile member after each transfer of three rows of cigarettes defining a cigarette block from said hopper means by said ejector means.

2. The apparatus of claim 1 wherein said feeding means comprises:

a further shaft positioned adjacent said one end shaft, cigarettes stored in said further shaft being guided into position in said one end shaft.

3. The apparatus of claim 2 wherein said feeding means further comprises:

pusher means for causing movement of cigarettes from said further shaft into said one end shaft.

4. The apparatus of claim 2 wherein said further shaft and said one end shaft are in communication at least at the level of the lowermost of said rows.

5. The apparatus of claim 4 wherein the lower end of said further shaft and said immobile member are shaped to permit cigarettes from said further shaft to move into said one end shaft under the influence of gravity.

6. The apparatus of claim 1 further comprising:

mouthpiece defining means for retaining the orientation of the cigarettes during transfer thereof from said hopper means by said ejector means, said mouthpiece defining means being positioned downstream from said hopper means in the direction of movement of the cigarettes during transfer, said mouthpiece defining means including at least a first guide rail for preventing relative movement between the cigarettes of said middle row and the cigarettes of said outer rows while the cigarettes are at least partially within said hopper means.

7. The apparatus of claim 6 wherein said feeding means comprises:

a further shaft positioned adjacent said one end shaft, cigarettes stored in said further shaft being guided into position in said one end shaft.

8. The apparatus of claim 7 wherein said feeding means further comprises:

pusher means for causing movement of cigarettes from said further shaft into said one end shaft.

9. The apparatus of claim 7 wherein the lower end of said further shaft and said immobile member are shaped to permit cigarettes from said further shaft to move into said one end shaft under the influence of gravity.

* * * * *